US010660454B2

(12) United States Patent
Fosse et al.

(10) Patent No.: US 10,660,454 B2
(45) Date of Patent: May 26, 2020

(54) CHILD CARRYING GARMENT

(71) Applicant: Lalabu LLC, Atlanta, GA (US)

(72) Inventors: Brian Fosse, Atlanta, GA (US); John Martin, Vashon, WA (US); Mirona Motoc, Seattle, WA (US); Brian Fletcher, Issaquah, WA (US); Zac West, Seattle, WA (US)

(73) Assignee: Lalabu LLC, Atlanta, GA (US)

( * ) Notice: Subject to any disclaimer, the term of this patent is extended or adjusted under 35 U.S.C. 154(b) by 0 days.

(21) Appl. No.: 15/861,546

(22) Filed: Jan. 3, 2018

(65) Prior Publication Data

US 2019/0200780 A1 Jul. 4, 2019

(51) Int. Cl.

| | |
|---|---|
| ***A47D 13/02*** | (2006.01) |
| ***A41D 11/00*** | (2006.01) |
| *A45F 3/14* | (2006.01) |

(52) U.S. Cl.

CPC ..... *A47D 13/025* (2013.01); *A41D 11/00* (2013.01); *A41D 2400/482* (2013.01);

(Continued)

(58) Field of Classification Search

CPC .... A47D 13/025; A47D 13/02; A47D 13/046; A47D 13/086; A41D 11/00; A41D 2400/482; A41D 2003/142; A41D 13/0007; A45F 2003/142; A45F 13/0007; A45F 2003/144; A45F 2003/146

(Continued)

(56) References Cited

U.S. PATENT DOCUMENTS 4,149,687 A * 4/1979 Nunemacher ..... A47D 13/025 224/159
4,449,253 A * 5/1984 Hettinger ..... A41D 13/0007 2/93

(Continued)

FOREIGN PATENT DOCUMENTS

| | | |
|---|---|---|
| CN | 101426456 A | 5/2009 |
| JP | 3787778 B2 | 6/2006 |
| WO | 2017200451 A1 | 11/2017 |

OTHER PUBLICATIONS

Restriction Requirement, dated Mar. 1, 2018, from corresponding U.S. Appl. No. 15/861,512.

(Continued)

*Primary Examiner* — Alissa L Hoey
(74) *Attorney, Agent, or Firm* — Brient IP Law

(57) ABSTRACT

A garment with an integrated carry system has a front panel, a rear panel, a first arm opening, a second arm opening, a first leg opening, a second leg opening, a first shoulder strap, and a second shoulder strap. The first shoulder strap comprises a first end coupled proximate the first arm opening and a second end coupled to the front panel proximate the first leg opening, where the first shoulder strap is removably received in a first compartment formed in the front panel intermediate the first arm opening and the first leg opening. The second shoulder strap has a first end coupled proximate the second arm opening and a second end coupled to the front panel proximate the second leg opening, where the second shoulder strap is removably received in a second compartment formed in the front panel intermediate the second arm opening and the second leg opening.

11 Claims, 12 Drawing Sheets

(52) U.S. Cl.
CPC ... *A45F 2003/142* (2013.01); *A45F 2003/144* (2013.01); *A45F 2003/146* (2013.01)

(58) Field of Classification Search
USPC ..... 224/160, 158, 159; 2/111, 94
See application file for complete search history.

(56) References Cited

U.S. PATENT DOCUMENTS 4,467,945 A * 8/1984 Schaapveld ..... A47D 13/025 224/160
4,602,390 A * 7/1986 Morera ..... A41D 27/20 2/247
5,205,450 A 4/1993 Derosier
5,547,461 A 8/1996 Levis
5,732,861 A 3/1998 Jakobson
5,766,114 A * 6/1998 Campbell ..... A47D 13/025 441/108
5,799,851 A * 9/1998 Wulf ..... A45C 7/0045 224/580
5,813,580 A * 9/1998 Fair ..... A47D 13/025 224/160
5,848,741 A 12/1998 Fair
6,179,187 B1 1/2001 Lemire et al.
6,240,564 B1 * 6/2001 Te Kanawa ..... A41D 13/0007 2/115
6,409,060 B2 6/2002 Donine
6,460,746 B1 * 10/2002 Amram ..... A45F 3/047 224/579
6,598,771 B2 * 7/2003 Norman ..... A47D 13/025 224/160
6,666,361 B1 * 12/2003 Lin ..... A45F 3/02 224/160
6,776,317 B1 * 8/2004 Parker ..... A45F 5/00 224/250
6,836,902 B2 * 1/2005 Marquez ..... A47D 13/046 2/69
7,204,002 B2 4/2007 Kaneko et al.
7,322,498 B2 1/2008 Frost
7,356,850 B2 * 4/2008 Turcotte ..... A41D 13/0007 182/3
D615,749 S * 5/2010 Wagner ..... D3/213
7,780,587 B2 * 8/2010 Thornton ..... A61H 3/008 119/770
7,819,831 B2 10/2010 Dellanno
7,971,273 B2 * 7/2011 Grilliot ..... A62B 17/006 2/227
8,028,871 B2 * 10/2011 Gray ..... A47D 15/006 224/158
8,272,507 B1 * 9/2012 Crump ..... A45F 5/00 206/223
8,363,181 B2 1/2013 Nasu et al.
8,567,652 B2 * 10/2013 Di Stasio ..... A45F 3/047 224/645
8,656,516 B1 * 2/2014 Reinhardt Rawlings ..... A41D 11/00 2/69
8,973,794 B2 * 3/2015 Bergkvist ..... A47D 13/025 224/159
9,277,830 B2 3/2016 Schachtner
9,848,713 B2 12/2017 Rosen et al.
9,949,575 B2 4/2018 Pond et al.
9,955,797 B2 5/2018 Telford et al.
10,172,437 B2 * 1/2019 Barber ..... A45F 3/04
10,441,091 B2 10/2019 Salazar et al.
2003/0172430 A1 * 9/2003 Jarrett ..... A41D 13/12 2/69
2003/0173150 A1 * 9/2003 Sharp ..... A62B 35/04 182/3
2004/0065708 A1 * 4/2004 Amram ..... A45F 3/047 224/579
2004/0149790 A1 8/2004 Kassai et al.
2005/0017566 A1 * 1/2005 Rizk ..... A41D 11/00 297/465
2005/0045674 A1 3/2005 Rehbein
2005/0184114 A1 * 8/2005 Hoff ..... A47D 13/025 224/160
2007/0029356 A1 2/2007 Moriguchi et al.
2007/0125815 A1 * 6/2007 Tong ..... A45C 5/14 224/153
2007/0254129 A1 * 11/2007 Horblitt ..... B32B 7/12 428/42.3
2007/0283480 A1 * 12/2007 Harris ..... A41B 13/005 2/80
2008/0156835 A1 * 7/2008 Schlipper ..... A45F 3/04 224/264
2008/0185409 A1 * 8/2008 Kellenberger ..... A45F 3/14 224/257
2009/0026235 A1 * 1/2009 Gray ..... A47D 13/025 224/160
2009/0206116 A1 * 8/2009 Grant ..... A45F 3/08 224/160
2009/0302075 A1 * 12/2009 Trainer ..... A47D 13/025 224/160
2010/0147910 A1 * 6/2010 Schachtner ..... A47D 13/025 224/160
2011/0062195 A1 3/2011 Jones et al.
2011/0185477 A1 * 8/2011 Olenicoff ..... A41D 27/20 2/247
2011/0186605 A1 * 8/2011 Favorito ..... A47D 13/025 224/160
2011/0290831 A1 * 12/2011 Wang ..... A47D 13/025 224/160
2012/0152987 A1 6/2012 Beltrame et al.
2013/0240590 A1 * 9/2013 Montgomery ..... A45F 3/08 224/636
2013/0327796 A1 * 12/2013 Poiani ..... A47D 13/02 224/160
2014/0131401 A1 * 5/2014 Workman ..... A47D 13/025 224/160
2014/0263491 A1 * 9/2014 Telford ..... A47D 13/025 224/160
2014/0361055 A1 * 12/2014 Myers ..... A62B 35/0018 224/160
2015/0014374 A1 * 1/2015 Nash ..... A47D 13/046 224/160
2015/0101108 A1 * 4/2015 Wallace ..... A41D 27/208 2/251
2015/0115002 A1 * 4/2015 Hyppolite ..... A47D 13/025 224/159
2015/0181953 A1 * 7/2015 Brown ..... A41D 11/00 2/69
2015/0201761 A1 * 7/2015 Wollenberg ..... A47D 13/025 224/576
2015/0335171 A1 * 11/2015 Tagle ..... A47D 13/025 224/160
2015/0374139 A1 * 12/2015 Salazar ..... A47D 13/025 224/160
2016/0150893 A1 * 6/2016 Salazar ..... A47D 13/025 224/160
2016/0249747 A1 * 9/2016 Yen ..... A47D 13/025 224/160
2017/0119173 A1 * 5/2017 Telford ..... A47D 13/025
2018/0116426 A1 5/2018 Telford
2018/0125124 A1 * 5/2018 Jylkka-Tesler ..... A41D 27/136
2018/0184813 A1 7/2018 Salazar et al.
2018/0206653 A1 7/2018 Andrus et al.
2019/0014920 A1 1/2019 Matsuyama
2019/0038044 A1 * 2/2019 Cummings ..... A47D 13/025
2019/0075939 A1 3/2019 Plested et al.
2019/0216232 A1 7/2019 Kee et al.

OTHER PUBLICATIONS

Office Action, dated Jun. 27, 2018, from corresponding U.S. Appl. No. 15/861,512.
International Search Report, dated Feb. 7, 2020, from corresponding International Application No. PCT/US2019/054466.
Invitation to Pay Additional Fees, dated Dec. 12, 2019, from corresponding International Application No. PCT/US19/54466.

(56) References Cited

OTHER PUBLICATIONS

Office Action, dated Nov. 26, 2019, from corresponding U.S. Appl. No. 16/591,284.
Written Opinion of the International Searching Authority, dated Feb. 7, 2020, from corresponding International Application No. PCT/US2019/054466.
Notice of Allowance, dated Mar. 13, 2020, from corresponding U.S. Appl. No. 16/591,284.

* cited by examiner

CHILD CARRYING GARMENT

BACKGROUND

Devices for carrying a baby or toddler typically require a harness that is used to attach the child to the adult that is carrying the child. Because the harness is not part of the child's or adults clothing, the harnesses must either be worn with or without the child in the harness or stored in a carry bag when not in use. Thus, the harness must be donned when the child wishes to be carried and doffed when the child is put down. Moreover, prior art harnesses require that the harness be at least partially donned by the adult before placing the child in the harness. Various embodiments of the present child carrying garment recognize and address the foregoing considerations, and others, of prior art devices.

SUMMARY

In various embodiments, a one piece garment with an integrated carry system comprises (1) a front panel, (2) a rear panel, (3) a first arm opening, (4) a second arm opening, (5) a first leg opening, (6) a second leg opening, (7) a first shoulder strap and (8) a second shoulder strap. The first shoulder strap comprises a first end coupled proximate the first arm opening, and a second end coupled to the front panel proximate the first leg opening. The second shoulder strap comprises a first end coupled proximate the second arm opening, and a second end coupled to the front panel proximate the second leg opening. In various embodiments, the one-piece garment comprises a first compartment formed in the front panel intermediate the first arm opening and the first leg opening, where the first shoulder strap is configured to be removably received in the first compartment. Additionally, the onepiece garment comprises a second compartment formed in the front panel intermediate the second arm opening and the second leg opening, where the second shoulder strap is configured to be removably received in the second compartment. In some embodiments, the first compartment defines a first opening that is selectively closeable by a first fastener, and the second compartment defines a second opening that is selectively closeable by a second fastener. In various embodiments, the first or second fasteners are selected from a group consisting of (a) a zipper, (b) one or more snaps, (c) one or more buttons, (d) one or more hooks and eyes, and (e) hook and loop. In some embodiments, the one-piece garment further comprises a headrest that is removably coupled to the back panel of the one piece garment. In some of these embodiments, the one-piece garment further comprises one or more fasteners coupled to the back panel of the one piece garment, where the one or more fasteners are configured to releasably couple the headrest to the back panel of the one piece garment. In certain embodiments, the first end of the first shoulder strap is releasably coupled to the back panel proximate the first arm hole, and the first end of the second shoulder strap is releasably coupled to the back panel proximate the second arm hole.

In other embodiments, a garment having an integrated carrying harness integrated therein comprises a front and a rear panel defining (a) a first leg opening, (b) a second leg opening, (c) a first arm opening, and (d) a second arm opening. The garment further comprises a first strap having a first end coupled proximate the first arm opening, and a second end coupled proximate the first leg opening. The garment also comprises a second strap having a first end coupled proximate the second arm opening, and a second end coupled proximate the second arm opening.

In various embodiments, the front panel defines a first compartment that has a first opening and a first fastener for closing the first opening. In some embodiments, the front panel defines a second compartment having a second opening and a second fastener for closing the second opening. In various embodiments, the first compartment is configure to receive the first strap therein, and the second compartment is configured to receive the second strap therein. In various embodiments, the first and second fasteners are selected from a group consisting of (1) a zipper, (2) one or more snaps, (3) one or more buttons, (4) one or more hooks and eyes, (5) hook and loop, and (6) one or more buckles and straps. In certain embodiments, the first and second fasteners are zippers.

In various embodiments, the first strap further comprises (1) a core first strap portion having a first end that is coupled to the first strap first end and a second end that is coupled to the first strap second end, and (2) an outer sheath second strap portion that surrounds the core first strap portion and has a first end that is coupled to the first strap first end and a second end that is coupled to the first strap second end. In some embodiments, the outer sheath second strap portion moves with respect to the core first strap portion between the strap first end and the strap second end. In various embodiments, the core first strap portion is stretchable between a un-stretched first length and a stretched second length that is larger than the un-stretched first length, and the outer sheath second strap portion has an adjustable length that limits the difference in length between the first length and the second length. In some embodiments, when the outer sheath second strap portion is adjusted to a third length, the core first strap portion is stretchable to a third length that is larger than the first length but smaller than the second length. In various embodiments, when a child is wearing the children's garment and a user is carrying the child using the first strap and the second strap, the outer sheath second strap portion supports the weight of the child.

In yet another embodiment of a garment for a child for carrying the child, the garment comprises a front panel, a rear panel, a first arm hole, a second arm hole, a first leg hole, and a second leg hole. The garment further comprises a first compartment formed in the front panel intermediate the first arm hole and the first leg hole, and a second compartment formed in the front panel intermediate the second arm hole and the second leg hole. The garment further comprises a first connection point positioned in the first compartment proximate to the first leg hole, a second connection point positioned in the second compartment proximate to the second leg hole, a third connection point positioned proximate to the first arm hole, and a fourth connection point positioned proximate to the second arm hole. The garment further comprises a first fastener for selectively closing the first compartment, and a second fastener for selectively closing the second compartment.

In various embodiments, a first shoulder strap comprises a first end, a second end, a first inner core portion that is coupled to the first shoulder strap first and second ends, and a second outer sheath portion that is coupled to the first shoulder strap first and second ends. In embodiments, the garment further comprises a second shoulder strap comprising a first end, a second end, a first inner core portion that is coupled to the second shoulder strap first and second ends, and a second outer sheath portion that is coupled to the second shoulder strap first and second ends. In various embodiments, (1) the first shoulder strap first end is operatively coupled to the first connection point, (2) the first shoulder strap second end is operatively coupled to the third connection point, (3) the second shoulder strap first end is operatively coupled to the second connection point, and (4) the second shoulder strap second end is operatively coupled to the fourth connection point.

In embodiments, the first shoulder strap first inner core portion is moveable between a first length, and a second length that is longer than the first length. In some embodiments, the first shoulder strap second outer sheath portion that is intermediate the first and second ends of the first shoulder strap moves with respect to the first inner core portion. In various embodiments, a length of the second outer sheath portion is adjustable between the second length and a third length that is shorter than the second length but longer than the first length.

BRIEF DESCRIPTION OF THE DRAWINGS

Various embodiments of the invention will be described below. In the course of the description, reference will be made to the accompanying drawings, which are not necessarily drawn to scale, and wherein.

DETAILED DESCRIPTION OF VARIOUS EMBODIMENTS

Various embodiments now will be described more fully hereinafter with reference to the accompanying drawings. It should be understood that the invention may be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
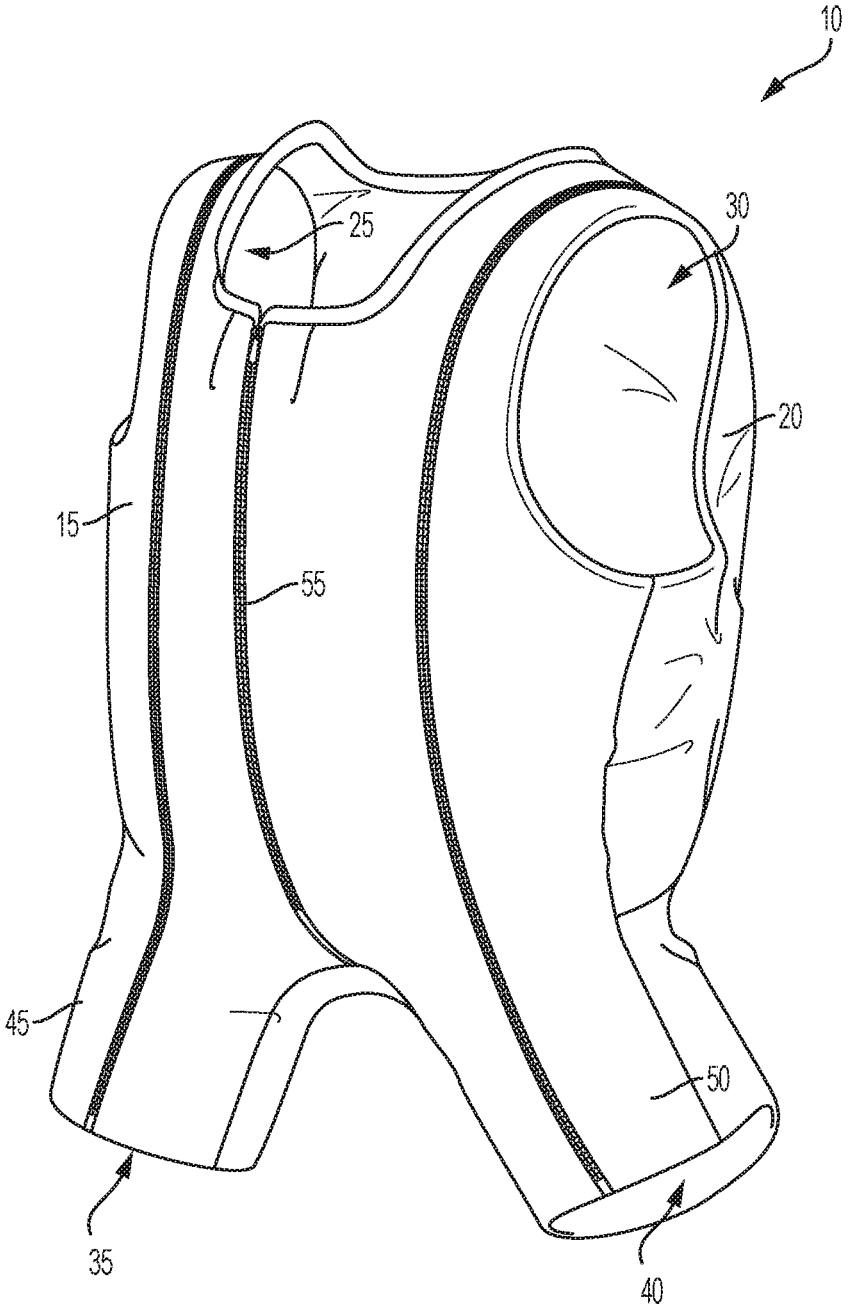
FIG. 1 is a perspective view of an embodiment of a child carrying garment having an integrated harness system.
Figure 2:
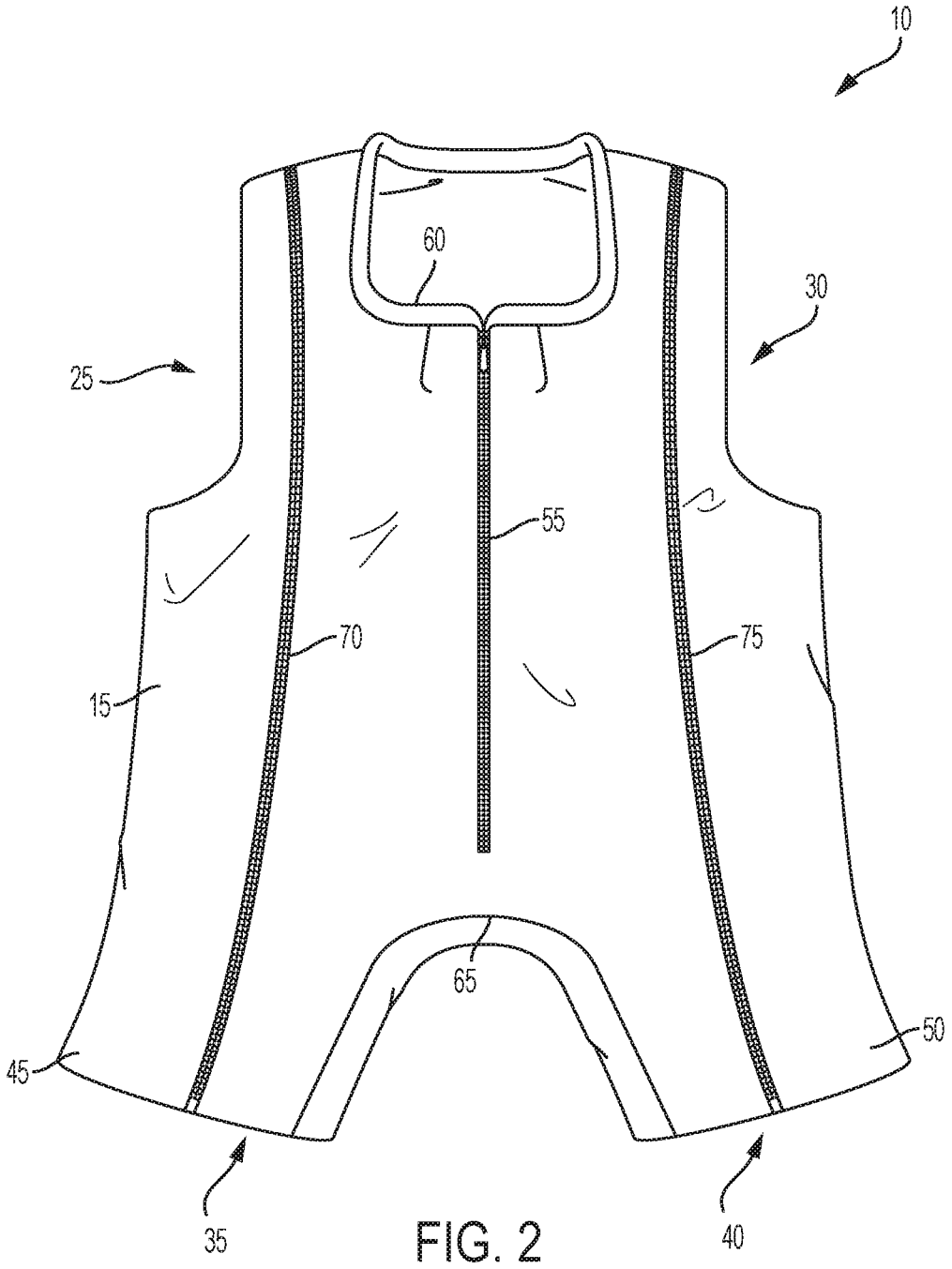
FIG. 2 is a front view of the child carrying garment of FIG. 1.

Referring to FIGS. 1 and 2, a one piece garment 10 with an integrated carry system is shown. In various embodiments, the one piece garment 10 may be formed from at least a front panel 15 and a rear panel 20. In various embodiments, the front and rear panels 15 and 20 may be integrally formed from one piece of material. In other embodiments, the front and rear panels 15 and 20 may be separate panels that are coupled together by stitching, a zipper, or some other suitable connection mechanism. The panels may be formed from any suitable material such as cotton, polyester, nylon, rayon, or any other suitable material or blend of materials. In various embodiments, the one piece garment may include an inner lining, padding or any other suitable fill material depending on the use of the garment. For example, for warm weather use, the material may be breathable and/or configured to wick away moisture. In cold weather use, the material may be configured to trap in heat or to protect the user from wind and/or rain. In various embodiments, the material may be reinforced to support the weight of a child.

In various embodiments, the front and rear panels define a first arm opening 25 and a second arm opening 30. In some embodiments, the first and second arm openings may be sleeveless. In other embodiments, the first and second arm openings 25 and 30 may be formed by a sleeve. In some embodiments, each sleeve may be formed from a separate material that is sewn to the first and second panels 15 and 20. In other embodiments, the first and second sleeve openings 25 and 30 may be integrally formed from the front panel 15 and rear panel 20.

In various embodiments, the one-piece garment contains a first leg opening 35 and a second leg opening 40. In some embodiments, the front and rear panels 15 and 20 together define the first leg opening 35 and the second leg opening 40. In other embodiments, the first and second leg openings 35 and 40 are further defined by pant legs 45 and 50. The pants legs 45 and 50 may be formed by separate material that is attached to the front and rear panels 15 and 20. In other embodiments, the pants legs 45 and 50 may be integrally formed with the front and rear panels 15 and 20.

Still referring to FIGS. 1 and 2, the one piece garment 10 includes a first fastener 55 that opens and closes the front panel 15. The first fastener 55, in various embodiments, may be a zipper. In other embodiments, the first fastener 55 may be any suitable fastener such as buttons, snaps, hooks, etc. In various embodiments, the first fastener may extend from a collar portion 60 proximate to a crotch area 65. In other embodiments, the first fastener 55 may extend from the collar portion 60 to a position intermediate the collar portion and the crotch area 65.

Figure 4:
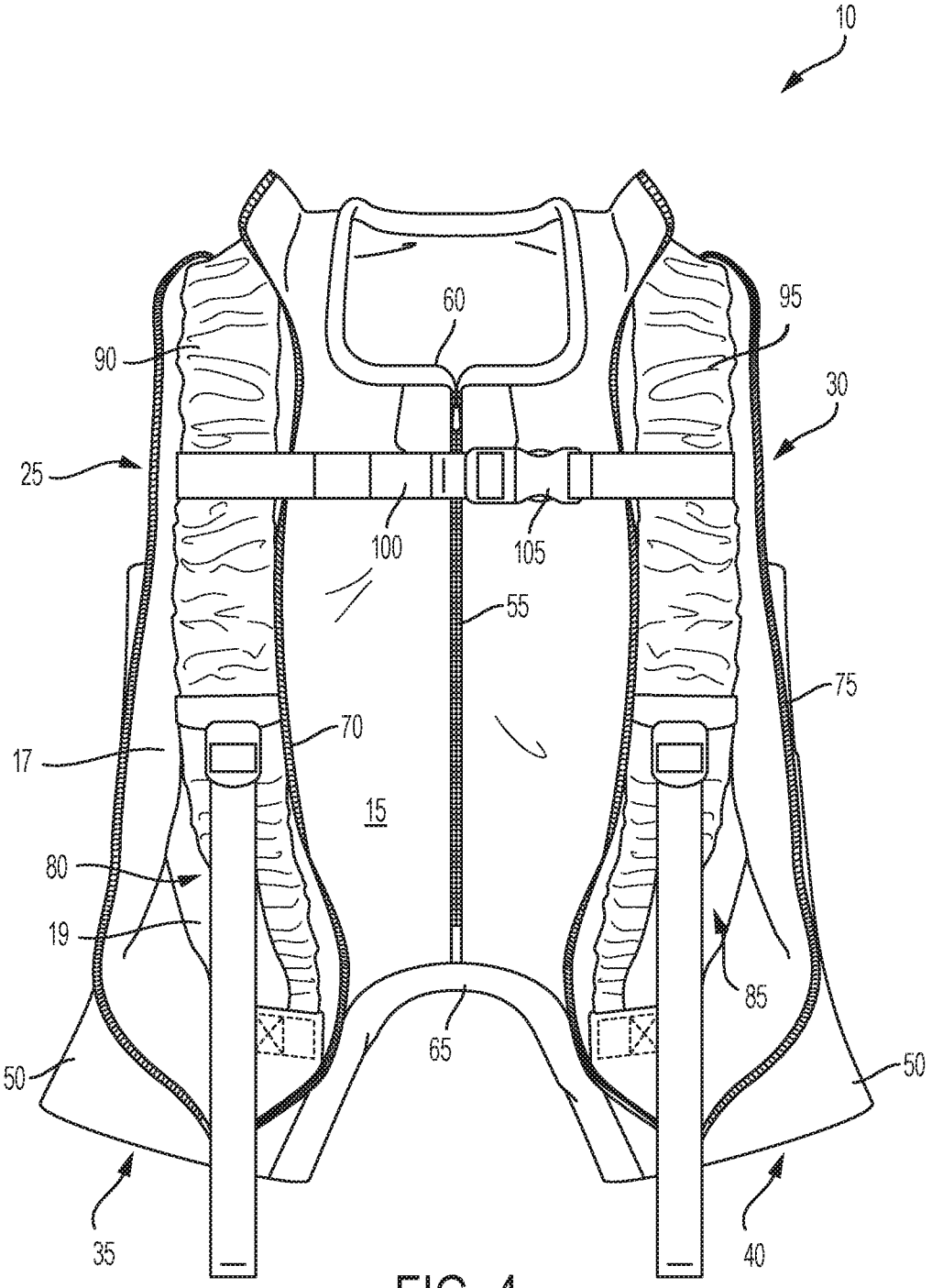
FIG. 4 is a front view of the child carrying garment of FIG. 1 with the carrying straps exposed.

Referring now to FIGS. 2 and 4, the one-piece garment 10 further comprises a second fastener 70 and a third fastener 75 that releasably close a first compartment 80 and second compartment 85. The second and third compartments 80 and 85, in various embodiments, extend vertically along the full height of the front panel 15. In some embodiments, the first and second compartments 80 and 85 may extend along a portion of the height of the front panel 15. Referring to FIG. 4, in some embodiments, the first and second compartments 80 and 85 may be formed intermediate a first layer 17 and a second layer 19 of the front panel 15. The first and second compartments 80 and 85 are configured to receive a first harness strap 90 and a second harness strap 95, which is described in more detail below. The first and second harness straps 90 and 95 are stretchable and can be easily accessed from and returned to the first and second compartments 80 and 85. A chest strap 100 extends from the first harness strap 90 to the second harness strap 95. The chest strap 100 may include a releasable buckle 105 that allows the user to don the first and second harness straps 90 and 95 over the wearer's shoulders prior to connecting the releasable buckle 105.

Figure 3:
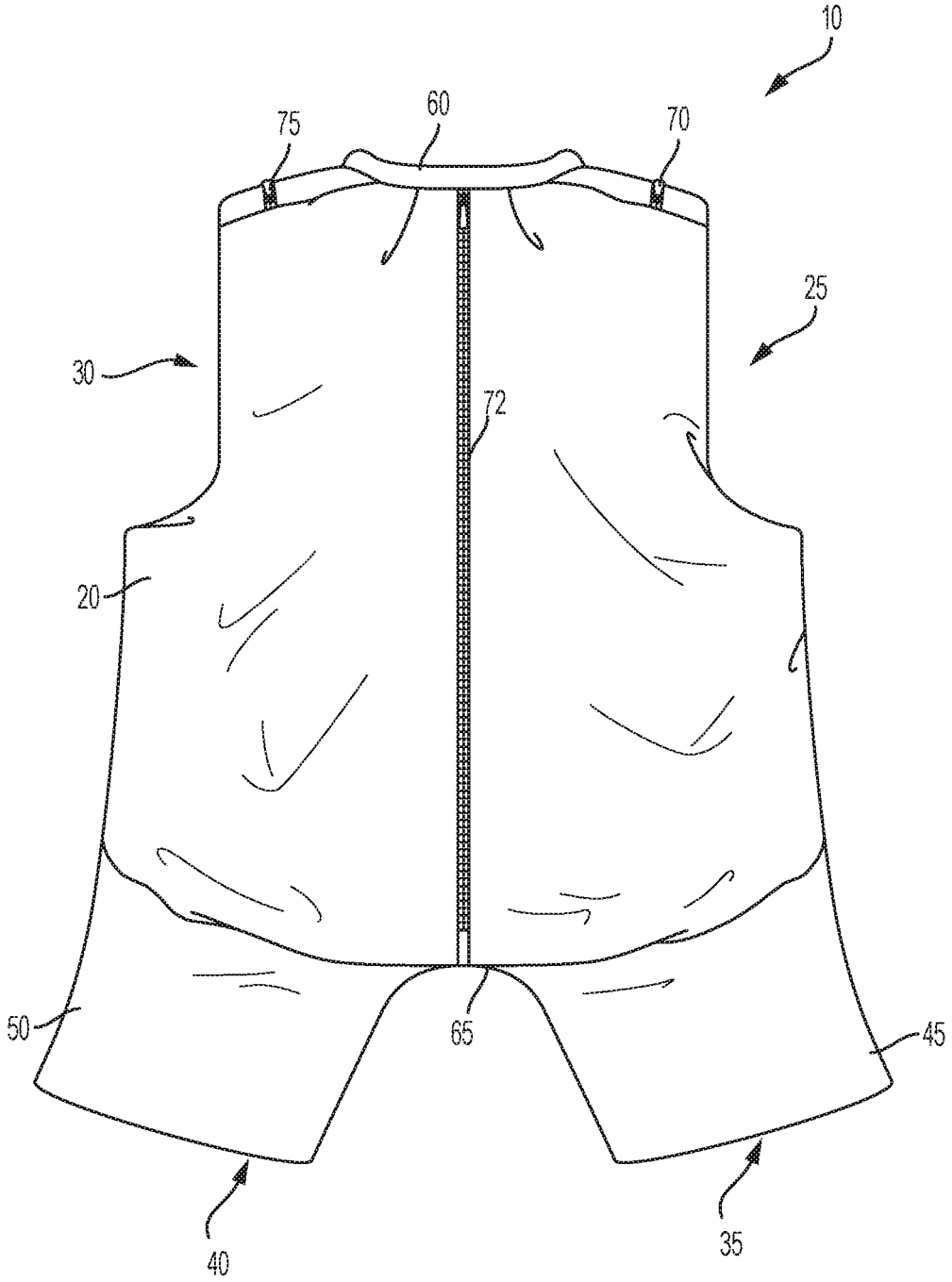
FIG. 3 is a back view of the child carrying garment of FIG. 1.

Referring now to FIG. 3, the one-piece garment 10 further comprises a fourth fastener 72 that extends from the collar portion 60 to the crotch area 65. The fourth fastener 72 may be any suitable fastener such as a zipper, buttons, hooks, hook and loop, snaps, etc. that allow the user to access a third compartment that is formed in the back panel 20.

Figure 5A:
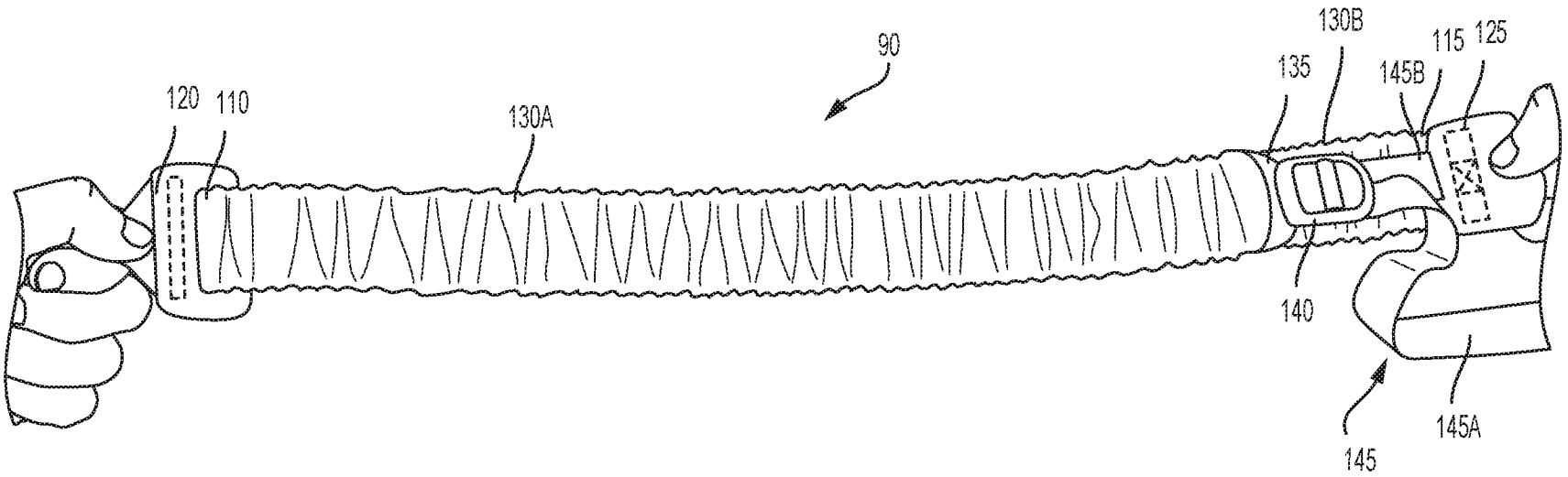
FIGS. 5A-5E are various views of a strap for use with the child carrying garment of FIG. 1.

Referring to FIGS. 5A-5E, the first and second shoulder straps 90 and 95 will be discussed in detail with reference only to shoulder strap 90 since each shoulder strap is essentially constructed and operates in the same manner. Referring to FIG. 5A, shoulder strap 90 comprises a first end 110 and a second end 115. The first end 110 is coupled to a first connector 120, and the second end 115 is coupled to a second connector 125. The first end 110 may be coupled to the first connector 120 by any suitable means such as rivets, snaps, buttons, stitching, etc. Similarly to the first end 110, the second end 115 may be coupled to the second connector 125 by any suitable means. In some embodiments, the first and second ends 110 and 115 of the strap 90 are respectively coupled to the first and second connectors 120 and 125 by stitching.

Still referring to FIG. 5A, shoulder strap 90 further comprises a first portion 130A that extends from the first end 110 to an anchor 135 and a second portion 130B that extends from the anchor 135 to the second end 115. Referring to FIG. 5E, the anchor 135 is coupled to an outer sheathing material 130. A buckle 140 is coupled to the anchor so that a strap 145 has a second end 145B attached to the second connector 125 and a first end 145A that is threaded through the buckle 140. Referring once more to FIG. 5E, the outer sheath 130 surrounds a core material 150 that extends from the first connector 120 to the second connector 125. In various embodiments, while the first and second ends of the out sheath 130 and the inner core material 150 are coupled to the first and second connectors 120 and 125, the sheath can move relative to the inner core material.

In various embodiments, the outer sheath material may be formed from any suitable material such as cotton, polyester, nylon or any other suitably strong material since the outer sheath material 130 provides the strength to carry the child in the once piece garment 10. In embodiments, the inner core material 150 is formed from an elastic material that can stretch and return to its original state. Thus, the outer sheath material 130 provides the carrying strength and the inner core material 150 provides a gathering action so that the shoulder strap 90 can easily be stored in its respective compartment. In various embodiments, the outer sheath material 130 is longer than the inner core material 150 so that the outer sheath material gathers and extends when the inner core material is stretched.

Figure 5B:
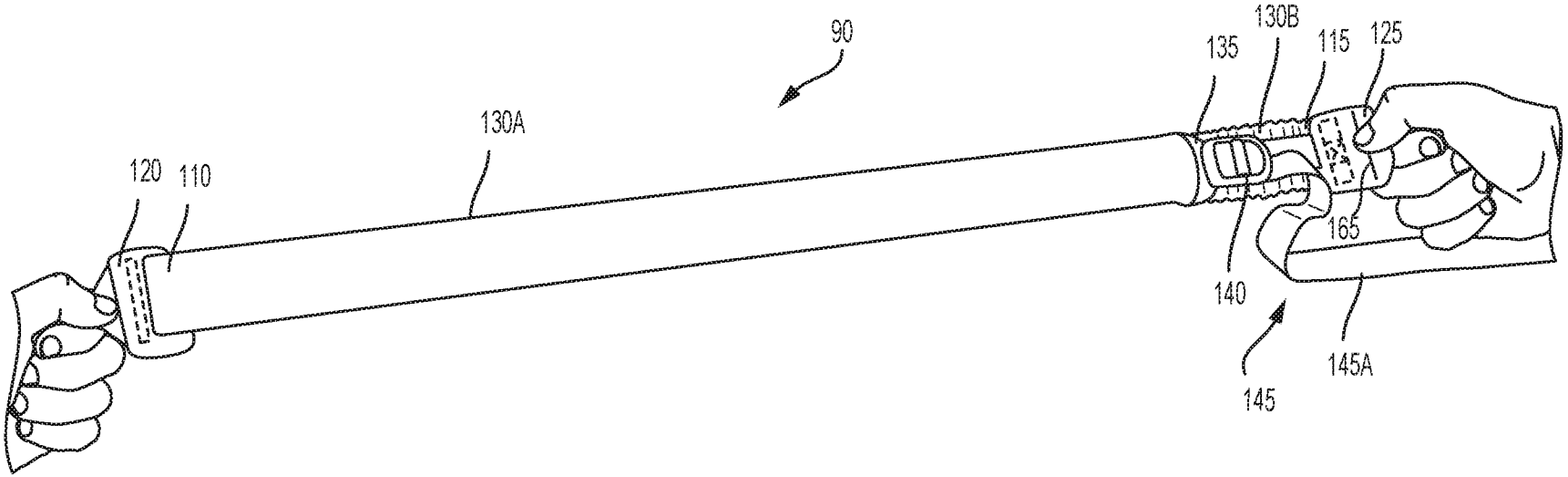

For example and referring to FIGS. 5A-5B, the shoulder strap 90 is shown in an unstretched first position in FIG. 5A where the outer sheath material 130 is gathered and the elastic inner core material 150 is unstretched. In FIG. 5B, the user is shown stretching the shoulder strap 90 into a second position where the outer sheath material 130 along the first portion 130B is lengthened and the inner core material 150 is stretched. In the second position shown in FIG. 5B, the second portion 130B of the shoulder strap 90 is not lengthened since the strap 145 between the buckle 140 and the second connector 125 prevents the second portion 130B of the shoulder strap 90 from lengthening.

Figure 5C:
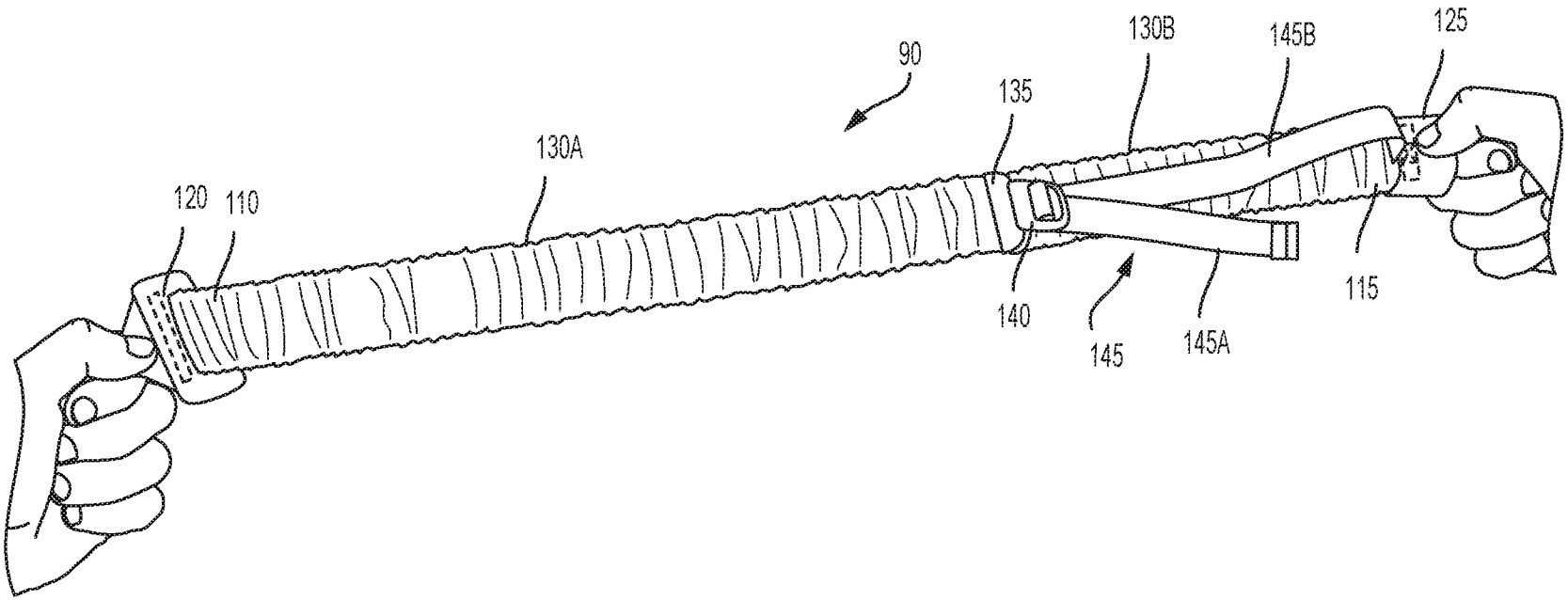
Figure 5D:
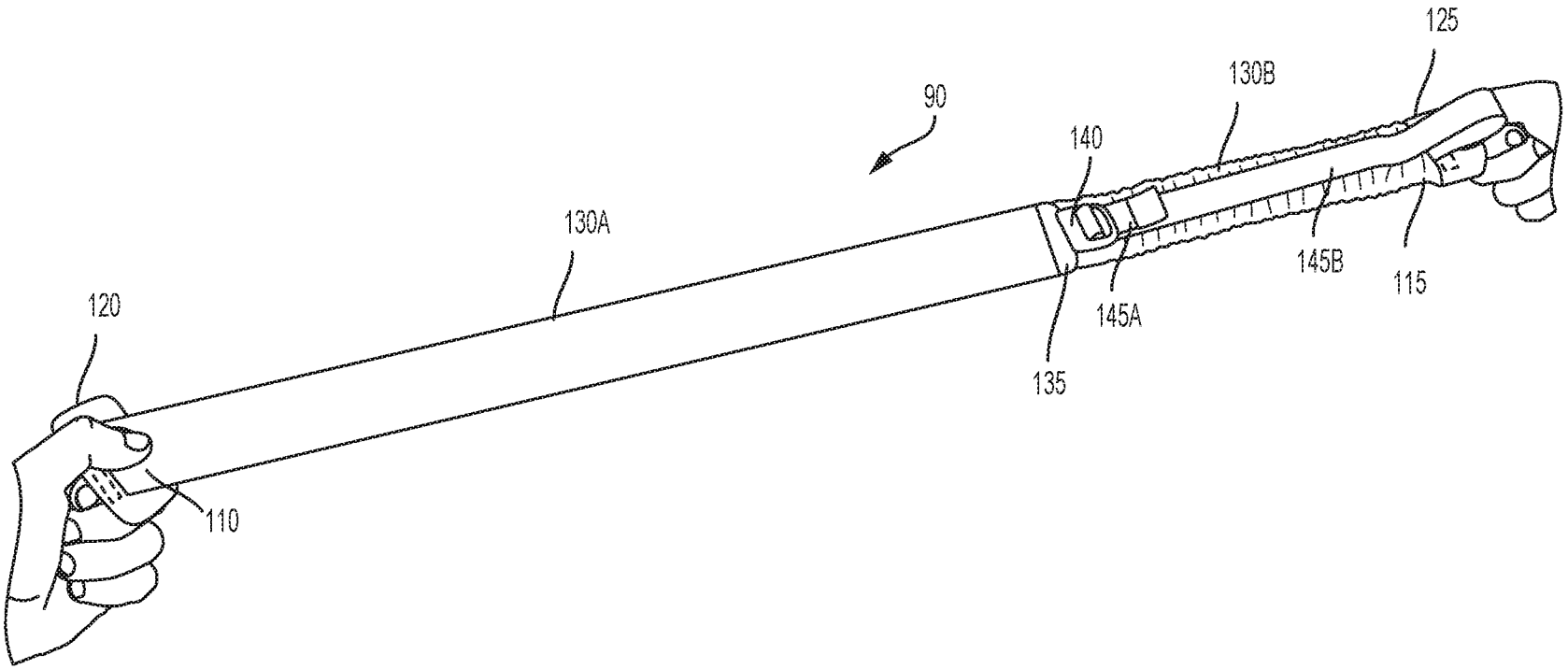
Figure 5E:
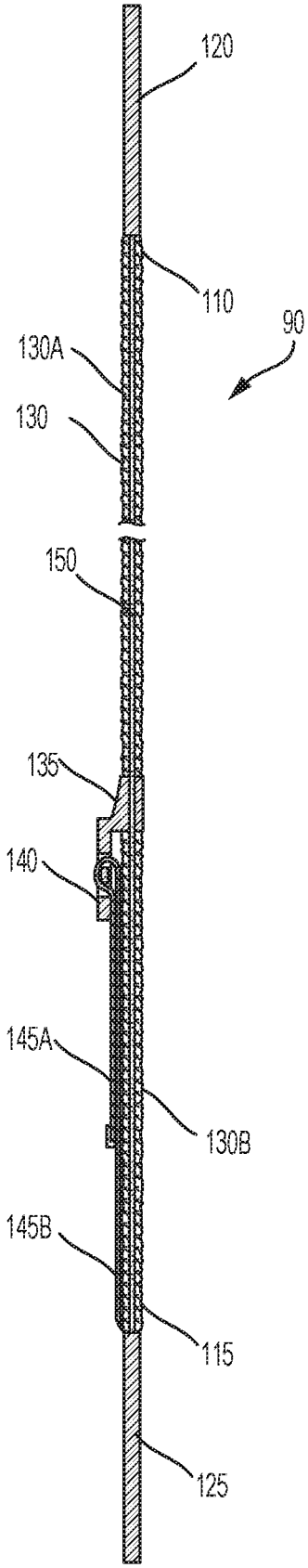

Referring to FIG. 5C, the shoulder strap 90 is shown with the overall length of the shoulder strap enlarged. This is accomplished by increasing the length of the strap 145 between the buckle 140 and the second connector 125. Thus, as the user increases the length of strap, the anchor 135 and the attached outer sheath can move with respect to the inner core material 150. In this condition, the overall length of the shoulder strap is increased since is can be stretched over a large distance. Said another way, as the length of the strap 145 increases between the anchor 135 and the second connector 125, the overall length of the shoulder strap 90 also increases. Referring particularly to FIG. 5D, the shoulder strap 90 shown in FIG. 5C is shown with the first portion outer sheath 130A lengthened and the second portion outer sheath 130B also lengthened by the same increased length of the strap 145B. Thus, the overall length of the shoulder strap 90 can be adjusted by lengthening or shortening the length of the strap 145 positioned between the buckle 140 and the second connector 125. Furthermore, when tension is removed from the shoulder strap 90, the strap returns to its first unstretched state where the outer sheath 130 gathers as the inner core 150 becomes unstretched.

Referring once again to FIG. 4, the first and second shoulder strap 90 and 95 are coupled to the once-piece garment to allow the user to carry a child wearing the garment. In particular, the first end of the first shoulder strap 90 is coupled to the one piece garment proximate the first arm hole 25, and the first end of the second shoulder strap 95 is coupled to the one piece garment proximate the second arm hole 30. Additionally, the second end of the first shoulder strap 90 is coupled to the one piece garment proximate to the first leg opening 35, and the second end of the second shoulder strap 95 is coupled to the one piece garment proximate to the second leg opening 40. In various embodiments, the first and second shoulder straps 90 and 95 may be releasably coupled to the one piece garment 10 using a fastener such as a button, a snap, or any other suitable fastener that allows the user to releasably couple the ends of the straps to the respective portions of the one piece garment 10. In other embodiments, the ends of the straps may be permanently attached to the one piece garment 10 by stitching, rivets or any other suitable fastener.

In various embodiments and still referring to FIG. 4, the first end of each strap extends over the top of the garment and is attached at the back panel of the garment. In some embodiments, the second ends of each strap couples to the front panel 15 of the garment inside its respective compartment 80 and 85. Referring to FIG. 6A, the first shoulder strap 90 is shown positioned in the compartment 80. The first end 110 of the first shoulder strap 90 passes through an opening 155 formed in the one piece garment 10 proximate the first arm hole 25 (FIG. 2) so that the first end 110 can be mounted to the one-piece garment in the third compartment enclosed by the fourth fastener 72 (FIG. 4). In this way, the first end can be mounted to the back panel inside the third compartment proximate to the first arm hole 25. The first end of the second shoulder strap 95 may be mounted to the one piece garment 10 in a similar manner so that it is coupled to the back panel 20 proximate to the second arm hole 30.

Figure 6B:
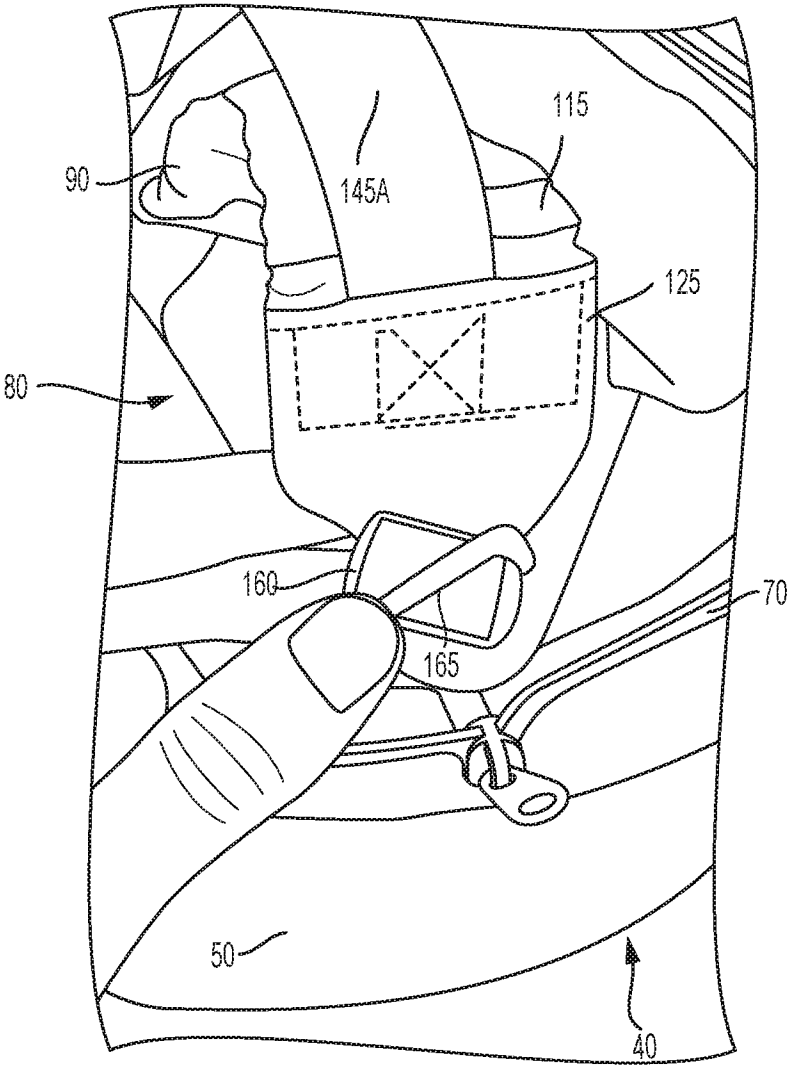
FIG. 6A-6B are close up view of the attachment of the integrated straps for the child carrying garment of FIG. 1.
Figure 6A:
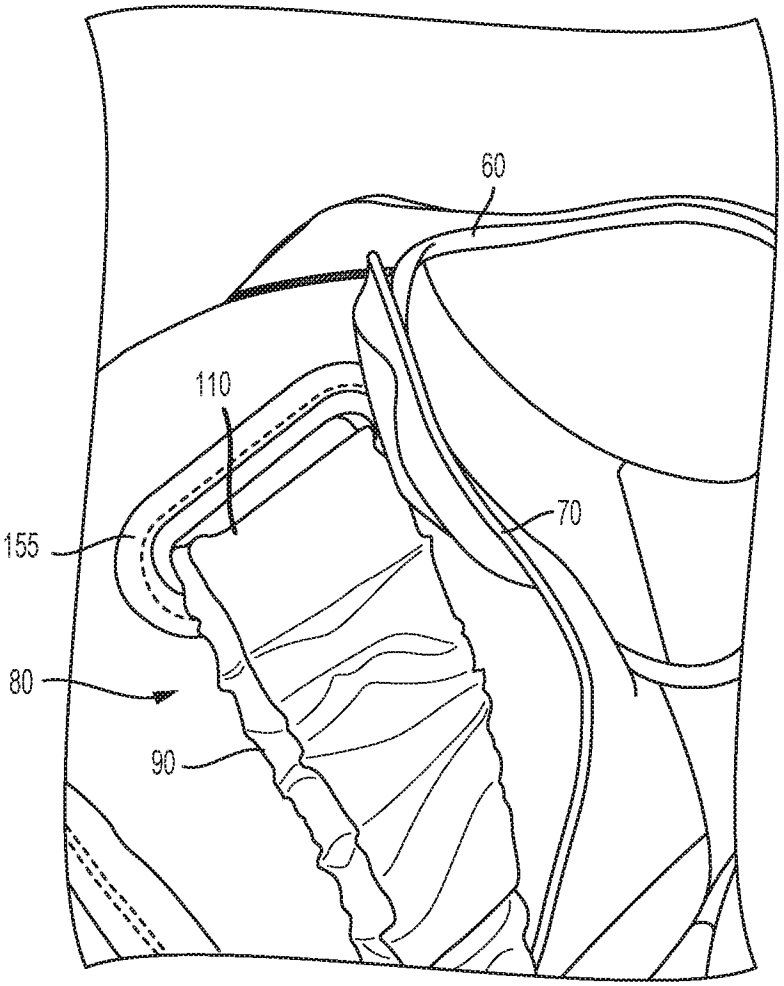

Referring to FIG. 6B, the second end 115 of the first shoulder strap is releasably coupled to the one piece garment 10 inside the first compartment 80 proximate to the first leg hole 40. In particular, the second end 115 is releasably coupled using a buckle 160 that is threaded through a slot 165 (FIGS. 5B and 6B) formed in the second connector 125. In this way, the shoulder straps are releasably connected and can be removed when the garment is being cleaned. In some embodiments, the second ends of the shoulder straps connect to the front panel of the one piece garment so that the child's legs are pulled up into a frog like position so as not to place undue pressure on the child's hip sockets. However, in other embodiments, the second ends of the shoulder straps may be connected in various positions proximate to the first and second leg holes 35 and 40.

Figure 7:
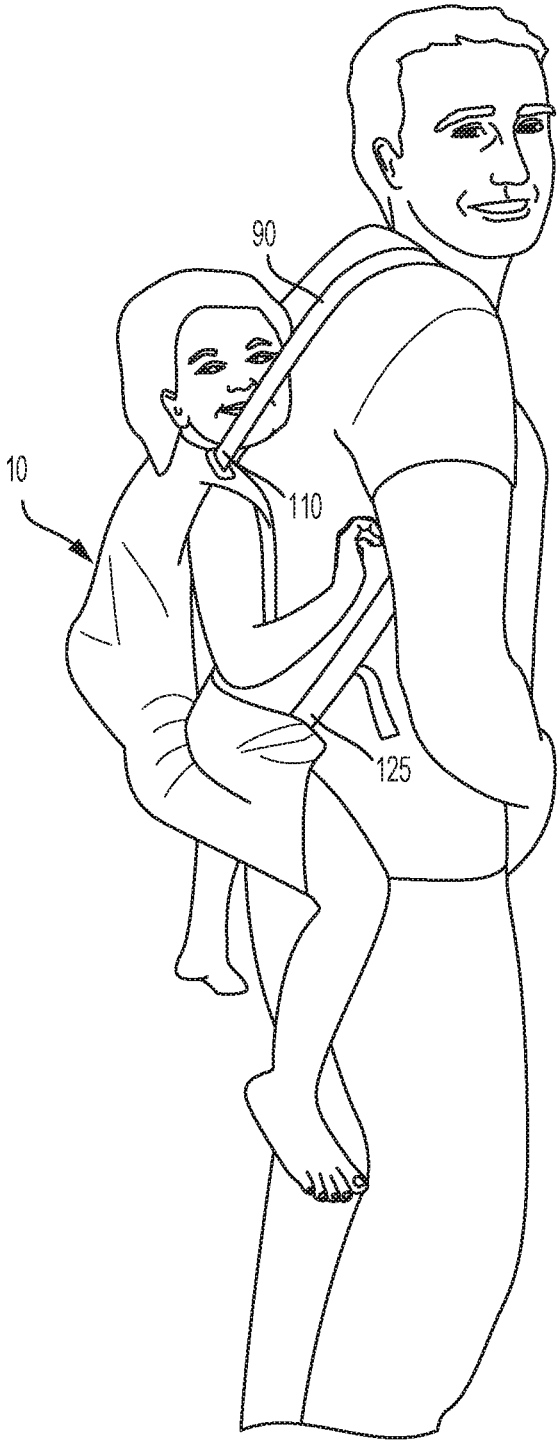
FIG. 7 is a perspective view showing use of the child carrying garment of FIG. 1 for carrying a child on the back of an adult.
Figure 8:
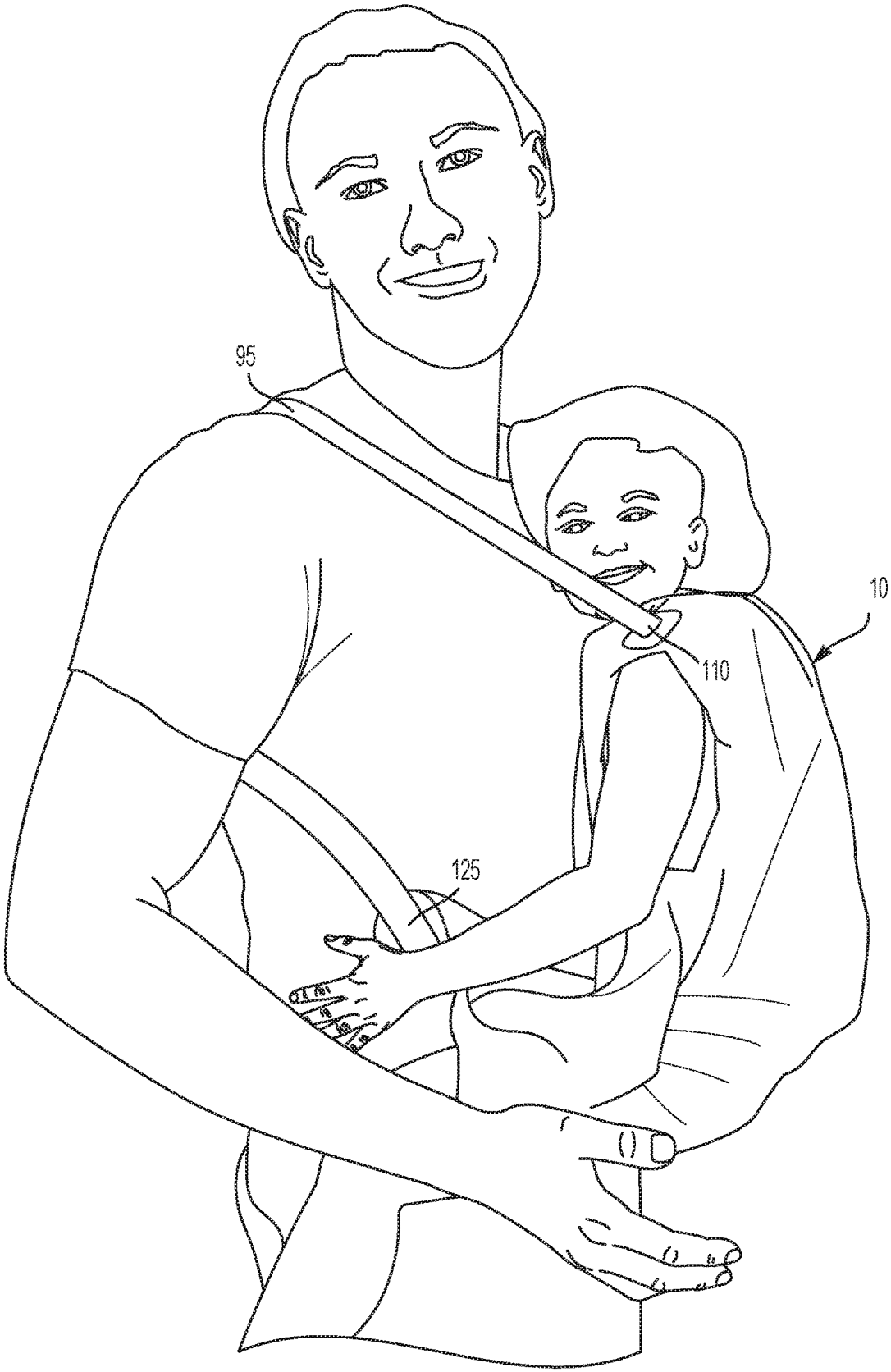
FIG. 8 is a perspective view showing use of the child carrying garment of FIG. 1 for carrying a child on the front of an adult.

Referring to FIGS. 7 and 8, the one-piece garment 10 with an integrated carrying harness is shown in use. In FIG. 7, the garment is shown being worn by a child that is carried by an adult on the adult's back. The first shoulder strap 90 is shown in a stretched state where the child is suspended from the adult's shoulders by the first and second shoulder straps. As discussed above, when the child is in this position, the outer sheath 130 of the shoulder strap 90 is supporting the child's weight in combination with the one-piece garment 10. Moreover, the attachment position of the second end 125 of the shoulder strap also positions the child's leg in a proper position. Referring to FIG. 8, the one piece garment 10 is shown being worn by a child that is being carried by an adult with the child leaning on the adult's chest. Once again, because of the attachment locations of the first end 110 and second end 125 of the shoulder straps, the child's legs are positioned appropriately so as not to place too much stress on the child's hip socket. Consequently, the one-piece garment 10 can be used to carry a child in one of two orientations—on the adult's back or against their chest.

In various embodiments, a headrest (not shown) may be used to support the head of a young child. In some embodiments, the headrest may be attached to the one-piece garment 10 along the collar 60 or at the top of the third compartment at the back panel 20. The headrest may be removably coupled to the one-piece garment using any suitable fastener such as hook and loop, snaps, or any other suitable fastener.

CONCLUSION

Many modifications and other embodiments of the invention will come to mind to one skilled in the art to which this invention pertains having the benefit of the teachings presented in the foregoing descriptions and the associated drawings. For example, as will be understood by one skilled in the relevant field in light of this disclosure, the invention may take form in a variety of different mechanical and operational configurations. Therefore, it is to be understood that the invention is not to be limited to the specific embodiments disclosed herein, and that the modifications and other embodiments are intended to be included within the scope of the appended exemplary concepts. Although specific terms are employed herein, they are used in a generic and descriptive sense only and not for the purposes of limitation.

What is claimed is:

1. A one piece garment with an integrated carry system comprising:

a. a front panel;
b. a rear panel;
c. a first arm opening;
d. a second arm opening;
e. a first leg opening;
f. a second leg opening;
g. a first shoulder strap comprising:
  i. a first strap first end coupled proximate the first arm opening within a first compartment formed in the front panel;
  ii. a first strap second end coupled to the front panel proximate the first leg opening at a position below a crotch area of the one piece garment and within the first compartment formed in the front panel;
  iii. a core first strap portion having a first end that is coupled to the first strap first end and a second end that is coupled to the first strap second end; and
  iv. an outer sheath second strap portion that surrounds the core first strap portion and has a first end that is coupled to the first strap first end and a second end that is coupled to the first strap second end;
h. a second shoulder strap comprising:
  i. a first end coupled proximate the second arm opening within a second compartment formed in the front panel;
  ii. a second end coupled to the front panel proximate the second leg opening at a position below the crotch area of the one piece garment and within a second compartment formed in the front panel;
i. the first compartment formed in the front panel intermediate the first arm opening and the first leg opening, the first compartment configured to receive the first strap first end of the first shoulder strap, the first strap second end of the first shoulder strap, and a continuous portion of the first shoulder strap from the first strap first end to the first strap second end; and
j. the second compartment formed in the front panel intermediate the second arm opening and the second leg opening, the second compartment configured to receive the first end of the second shoulder strap, the second end of the second shoulder strap, and a continuous portion of the second shoulder strap from the first end to the second end.

2. The one piece garment of claim 1, a. wherein the first shoulder strap is configured to be removably received in the first compartment; and
b. wherein the second shoulder strap is configured to be removably received in the second compartment.

3. The one piece garment of claim 2, wherein:

a. the first compartment defines a first opening that is selectively closeable by a first fastener; and
b. the second compartment defines a second opening that is selectively closeable by a second fastener.

4. The one piece garment of claim 3, wherein one of the first fastener or the second fastener is selected from a group consisting of:

a. a zipper;
b. one or more snaps;
c. one or more buttons;
d. one or more hooks and eyes; and
e. hook and loop.

5. A garment having an integrated carrying harness integrated therein, the garment comprising:

a. a front and rear panel defining:
  i. a first leg opening;
  ii. a second leg opening;
  iii. a first arm opening;
  iv. a second arm opening;
  v. a first compartment in the front panel comprising a first opening and a first fastener for closing the first opening; and
  vi. a second compartment in the front panel comprising a second opening and a second fastener for closing the second opening;
b. a first strap having:
  i. a first strap first end coupled proximate the first arm opening;
  ii. a first strap second end coupled proximate the first leg opening;
  iii. a core first strap portion having a first end that is coupled to the first strap first end and a second end that is coupled to the first strap second end; and
  iv. an outer sheath second strap portion that surrounds the core first strap portion and has a first end that is coupled to the first strap first end and a second end that is coupled to the first strap second end; and
c. a second strap having:
  i. a first end coupled proximate the second arm opening; and ii. a second end coupled proximate the second leg opening, wherein:

the first compartment is configured to receive the first end and the second end of the first strap therein while the first strap remains coupled proximate the first arm opening and proximate the first leg opening, and the second compartment is configured to receive the first end and the second end of the second strap therein while the second strap remains coupled proximate the second arm opening and proximate the second leg opening.

6. The garment of claim 5, wherein the first fastener and the second fastener is selected from a group consisting of:

a. a zipper;

b. one or more snaps;

c. one or more buttons;

d. one or more hooks and eyes;

e. hook and loop; and f. one or more buckles and straps.

7. The garment of claim 5, wherein the first fastener and the second fastener are zippers.

8. The garment of claim 5, wherein the outer sheath second strap portion moves with respect to the core first strap portion between the strap first end and the strap second end.

9. The garment of claim 5, wherein:

a. the core first strap portion is configured to be stretched between an un-stretched first length and a stretched second length that is larger than the un-stretched first length; and b. the outer sheath second strap portion has an adjustable length that is configured to limit the difference in length between the first length and the second length.

10. The garment of claim 9, wherein when the outer sheath second strap portion is configured to be adjusted to a third length, the core first strap portion is stretchable to a third length that is larger than the first length but smaller than the second length.

11. The garment of claim 5, wherein the outer sheath second strap portion is configured to support the weight placed on the first strap by a child supported by the garment.

* * * * *